US010794040B2

(12) United States Patent
Leonard

(10) Patent No.: US 10,794,040 B2
(45) Date of Patent: Oct. 6, 2020

(54) AUTONOMOUS VERTICALLY-ADJUSTABLE DREDGE

(71) Applicant: Jeremy Leonard, Ardrossan (CA)

(72) Inventor: Jeremy Leonard, Ardrossan (CA)

( * ) Notice: Subject to any disclaimer, the term of this patent is extended or adjusted under 35 U.S.C. 154(b) by 295 days.

(21) Appl. No.: 15/991,969

(22) Filed: May 29, 2018

(65) Prior Publication Data

US 2019/0345687 A1 Nov. 14, 2019

(51) Int. Cl.

| | |
|---|---|
| ***E02F 3/88*** | (2006.01) |
| ***E02F 3/90*** | (2006.01) |
| ***E02F 5/28*** | (2006.01) |
| ***E02F 9/26*** | (2006.01) |
| ***E02F 9/20*** | (2006.01) |

(52) U.S. Cl.

CPC ..... *E02F 3/8808* (2013.01); *E02F 3/8875* (2013.01); *E02F 3/905* (2013.01); *E02F 3/907* (2013.01); *E02F 5/282* (2013.01); *E02F 9/2016* (2013.01); *E02F 9/265* (2013.01)

(58) Field of Classification Search

CPC ..... E02F 3/8808; E02F 3/8816; E02F 3/8866; E02F 3/8858; E02F 3/8875; E02F 3/48; E02F 3/905; E02F 3/907; E02F 5/282; E02F 9/2016; E02F 9/265

See application file for complete search history.

(56) References Cited

U.S. PATENT DOCUMENTS 1,547,949 A * 7/1925 Newsom ..... E02F 7/06 37/317
2,933,837 A 4/1960 Nelson
3,010,232 A 11/1961 Skakel et al.
3,222,876 A 12/1965 Harmstorf
3,365,823 A * 1/1968 Vogt ..... E02F 5/006 37/314
3,588,174 A 6/1971 Rossfelder et al.

(Continued)

FOREIGN PATENT DOCUMENTS

CA 2730861 A1 8/2011
EP 3333327 A1 * 6/2018 ..... E02F 9/065

(Continued)

OTHER PUBLICATIONS

"Horizontal Dredge Technology," VMI, Inc., <http://www.vmi-dredges.com/index.php/horizontal-dredges/technology/> [retrieved Sep. 27, 2017], 1 page.

(Continued)

*Primary Examiner* — Jamie L McGowan
(74) *Attorney, Agent, or Firm* — Christensen O'Connor; Johnson Kindness PLLC

(57) ABSTRACT

A method of dredging a bottom of a body of water is provided. Winching stations are positioned around the perimeter of an area to be dredged and a cable from each winching station is connected to a float. The cables pass through a variable resistance pulley assembly attached to a submersible assembly having a cutter and a submersible pump and are tensioned to suspend the submersible assembly. The cutter and submersible pump are activated and the winches are controlled to move the submersible assembly in a dredging pattern. When an obstacle is encountered the resistance of the pulley assembly is decreased and sufficient tension is applied to the cables to lift the submersible assembly toward the float.

18 Claims, 10 Drawing Sheets

(56) References Cited

U.S. PATENT DOCUMENTS 3,624,933 A 12/1971 Faldi
3,693,272 A 9/1972 Gariel
3,748,760 A * 7/1973 Schnell ..... E02F 3/905 37/318
3,763,580 A 10/1973 Kuntz, Jr.
3,924,896 A 12/1975 Blankenship
4,004,357 A * 1/1977 Faldi ..... E02F 3/90 37/320
4,177,585 A * 12/1979 de Koning ..... E02F 3/905 37/195
4,184,958 A * 1/1980 Manchak, Jr. ..... B09B 3/0041 210/170.09
4,451,177 A 5/1984 Goldsmith
4,470,208 A 9/1984 Van Berk et al.
4,818,390 A * 4/1989 Manchak, Jr. ..... B09B 1/00 210/170.08
5,250,199 A * 10/1993 Haag ..... B01D 21/245 210/803
5,286,384 A * 2/1994 Haag ..... B01D 21/18 210/527
5,412,884 A * 5/1995 Staples ..... E02F 3/52 37/314
6,038,795 A * 3/2000 Navarro ..... E02F 3/60 172/26.5
6,041,527 A 3/2000 Hostetler
6,125,560 A 10/2000 Beaumont
6,584,709 B2 * 7/2003 Martel, Jr. ..... E02B 3/023 37/313
6,625,907 B2 9/2003 Murray et al.
7,083,734 B2 8/2006 Happonen
8,935,863 B2 * 1/2015 Leonard ..... E02F 3/8866 210/747.4
9,027,263 B2 * 5/2015 Leonard ..... E02F 3/907 37/309
2002/0059740 A1 * 5/2002 Murray ..... E02F 3/8841 37/317
2003/0062319 A1 4/2003 Keller et al.
2005/0016931 A1 1/2005 Keller et al.
2005/0268499 A1 12/2005 Weinrib et al.
2016/0194851 A1 7/2016 De Keizer

FOREIGN PATENT DOCUMENTS

GB 2103099 A 2/1983
JP 2008223433 A 3/2007
JP 2008223433 * 9/2008 ..... E02F 3/88
KR 20160000111 U 1/2016

OTHER PUBLICATIONS

"Sludge Sled," Sediment Control Systems, Inc., <http://www.sedimentcontrolsystems.com> [retrieved Sep. 27, 2017], 2 pages.
"SlurryRat®," UAT Pty. Ltd., Australia, <http://www.uat.com.au/slurryrat.html> [retrieved Sep. 27, 2017], 2 pages.

* cited by examiner

AUTONOMOUS VERTICALLY-ADJUSTABLE DREDGE

TECHNICAL FIELD

This relates to a method and apparatus for dredging bodies of water, and in particular, to dredging using winching stations placed around the area to be dredged.

BACKGROUND

Bodies of water are commonly dredged in order to clean the bed of the body of water and removed deposits such as mud, weeds, or refuse. U.S. Pat. No. 8,935,863 (Leonard) entitled "Method of dredging a pond" describes a method and apparatus for dredging a body of water using winching stations placed around the perimeter of the body of water, and allowing for control of the position and movement of the dredge using the winches.

SUMMARY

According to an aspect, there is provided a method of dredging a bottom of a body of water, comprising positioning at least three winching stations spaced at intervals around the perimeter of an area to be dredged, wherein each winching station comprises a winch and a length of cable, connecting a remote end of each cable from each winching station to a float, the cable passing through a pulley assembly attached to a submersible assembly, the pulley assembly applying a variable resistance to cable movement, and the submersible assembly comprising a cutter and a submersible pump, tensioning the cables sufficiently to suspend the submersible assembly with the bottom of the body of water, activating the cutter and submersible pump, controlling in a coordinated manner the operation of the winches from each winching station to move the submersible assembly in a dredging pattern over the area to be dredged, when an obstacle is encountered, decreasing the resistance of the pulley assembly and applying sufficient tension on the cable to lift the submersible assembly toward the float.

According to other aspects, when the submersible assembly is lifted, the float may be vertically above and aligned with the submersible assembly, when a top of the obstacle is reached, the resistance on the pulley assembly may be increased and the tension of the cables may be controlled to cause the submersible assembly to traverse the top of the obstacle, when the obstacle is traversed the resistance of the pulley assembly may be decreased to permit the submersible assembly to move toward a desired depth below the float, the method may further comprise the step of increasing the resistance of the pulley assembly when the desired depth is reached, controlling the resistance of the pulley assemblies may comprise locking the pulley assemblies to fix a depth of the submersible assembly within the body of water, the method may further comprise the step of controlling the resistance of the pulley assemblies and the tension of the cables to cause the submersible assembly to follow contours of the bottom of the body of water, the pulley assembly may comprise a variable resistance pulley, and the method may further comprise the step of detecting an obstacle based on at least the tension in the cables between the pulley assembly and the winches.

According to an aspect, there is provided a method of dredging a bottom of a body of water, comprising positioning at least three winching stations spaced at intervals around the perimeter of an area to be dredged, wherein each winching station comprises a winch and a length of cable, connecting a remote end of each cable from each winching station to a float, the cable passing through a pulley assembly attached to a submersible assembly, the pulley assembly applying a variable resistance to cable movement, and the submersible assembly comprising a cutter and a submersible pump, tensioning the cables sufficiently to suspend the submersible assembly in contact with the bottom of the body of water, activating the cutter and submersible pump, controlling in a coordinated manner the operation of the winches from each winching station to move the submersible assembly in a dredging pattern over the area to be dredged, and controlling the resistance of the pulley assembly and the tension of the cables to control the vertical position of the submersible assembly.

According to other aspects, controlling the resistance of the pulley assembly and the tension of the cables may comprise, when an obstacle is encountered, decreasing the resistance of the pulley assembly and applying sufficient tension on the cable to lift the submersible assembly toward the float, increasing the resistance of the pulley assembly at a top of the obstacle and controlling the tension of the cables to traverse the obstacle, and when the obstacle has been traversed, decreasing the resistance of the pulley assembly to permit the submersible assembly to move toward a desired depth below the float, and thereafter increasing the resistance of the pulley assembly when the desired depth is reached, when the submersible assembly is lifted, the float may be vertically above and aligned with the submersible assembly, the resistance of the pulley assemblies and the tension of the cables may be controlled to cause the submersible assembly to follow contours of the bottom of the body of water, controlling the resistance of the pulley assemblies may comprise locking the pulleys to fix a depth of the submersible assembly within the body of water, the pulley assembly may comprise a variable resistance pulley, and the method may further comprise the step of detecting an obstacle based on the tension in the cables between the pulley assembly and the winches.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

A method of dredging a bottom of a body of water will now be described with reference to FIG. 1 through 10.

Figure 8:
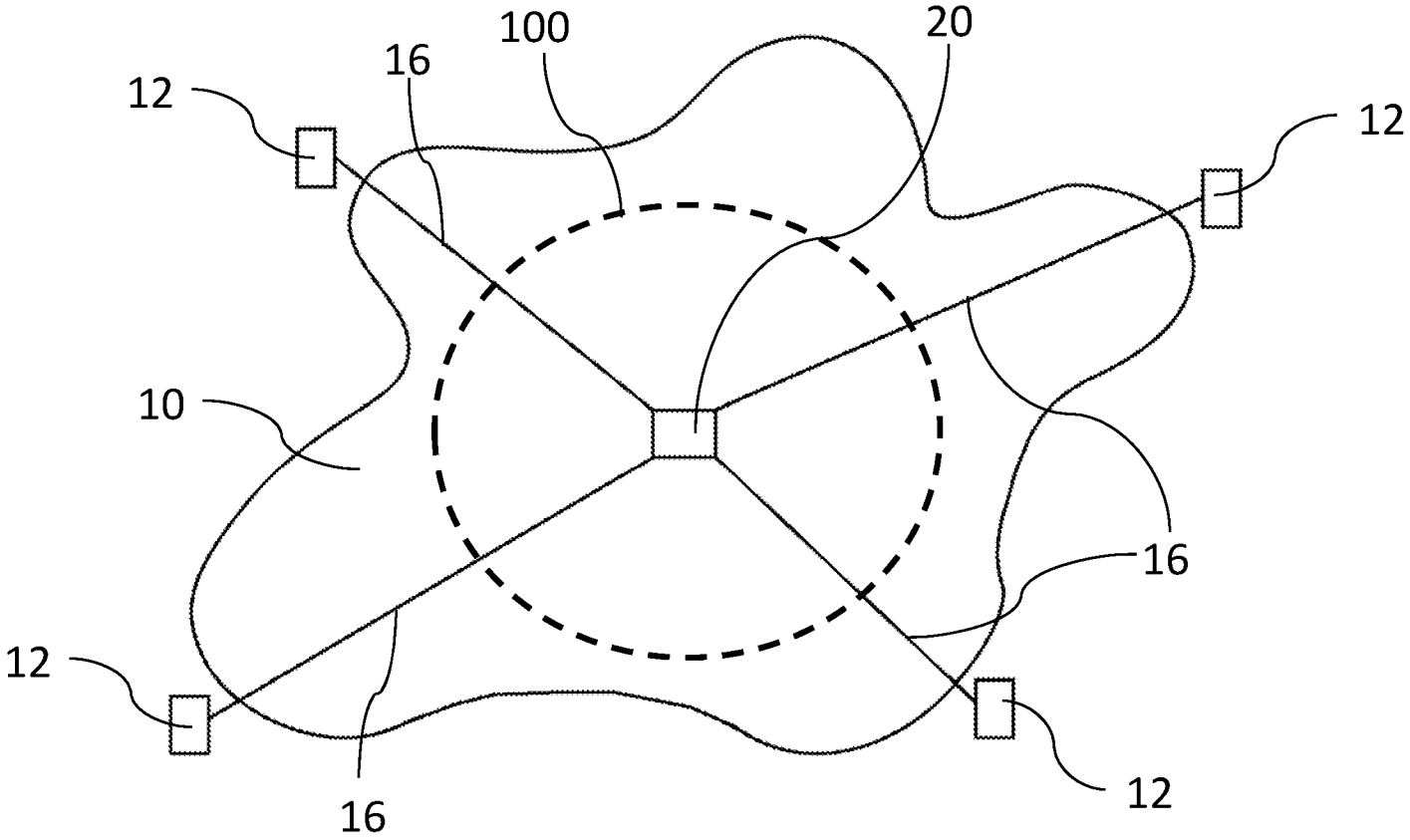
FIG. 8 is a top plan view of a body of water with four winching stations and a submersible assembly.
Figure 9:
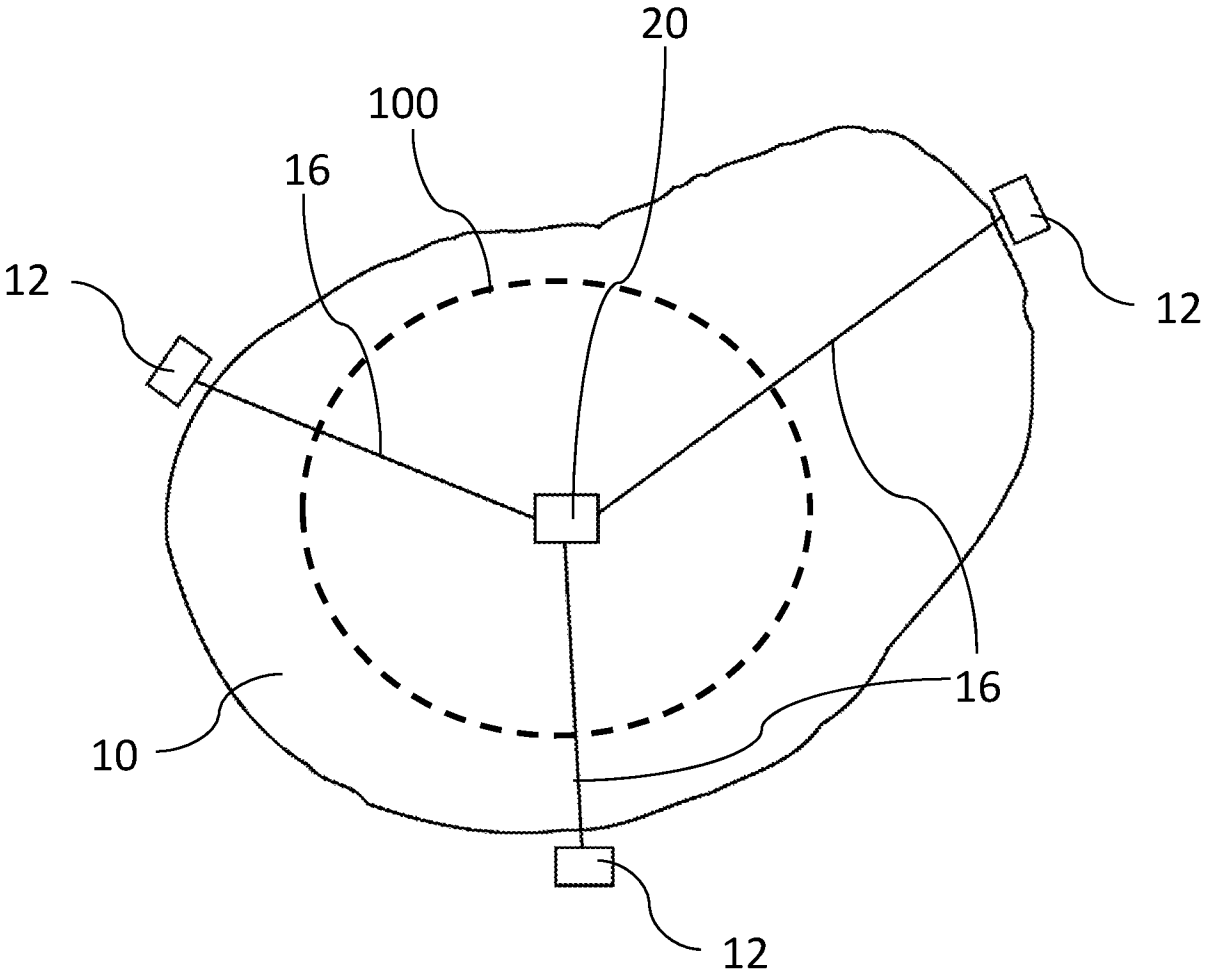
FIG. 9 is a top plan view of a body of water with three winching stations and a submersible assembly.

Referring to FIG. 8 and FIG. 9, when a body of water 10 requires dredging, at least three winching stations 12 are spaced at intervals around the perimeter of an area to be dredged, generally identified by reference number 100. FIG. 8 and FIG. 9 show arrangements with four and three winching stations 12, which will cover the majority of situations. It will be understood that more winching stations 12 may be used in some circumstances. However, in order to provide lateral movement of a dredge within a plane, at least three winching stations 12 are required. Lateral movement of the dredge within a plane may also be provided by having only two winching stations 12 if the position of a float 20 from which the dredge is suspended is controlled, however this makes the controls and installation more complex and costly.

As will be understood, the area to be dredged may be an entire body of water, in which case the perimeter of the area to be dredged is represented by the perimeter of the body of water 10. In other cases, the area to be dredged may be a portion of the body of water 10, or may be a specified area within the body of water 10, such as the area defined by circle 100. The actual outline of the area being dredged may be a complex pattern or geometric shape, depending on the needs of the particular application. In addition, if the body of water 10 is large or spaced from the shoreline, or if the shoreline is unstable, winching stations 12 may be placed on anchored platforms on the body of water that are spaced around the area to be dredged. It will also be understood that the intervals between winching stations 12 may vary depending on the area to be dredged. Winching stations 12 may be evenly spaced about the area to be dredged, or the spacing may be variable between the stations. Once the principles described herein are understood, there may be other considerations related to the design and placement of winching stations 12 as will be recognized by those skilled in the art, and will not be discussed further.

Figure 10:
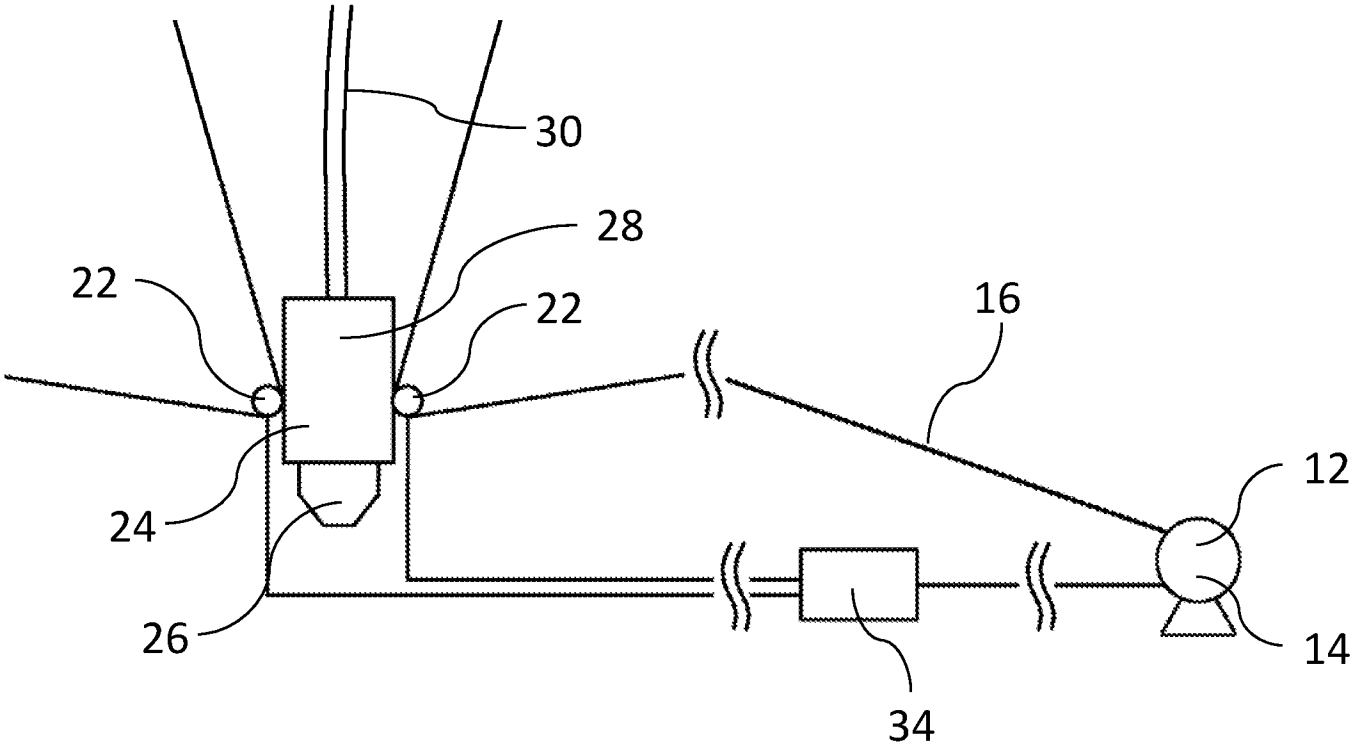
FIG. 10 is a schematic view of a submersible pump and controller assembly.

Referring to FIG. 10, each winching station 12 has a winch 14 and a length of cable 16, as shown in FIG. 10, and is controlled by a controller 34. Controller 34 will generally be a computer controller, and may be any suitable design. For example, each winch 14 may have a localized controller in communication with a central controller, or each winch may be directly controlled by a central controller. Other design schema may also be used to implement the steps described herein.

Figure 1:
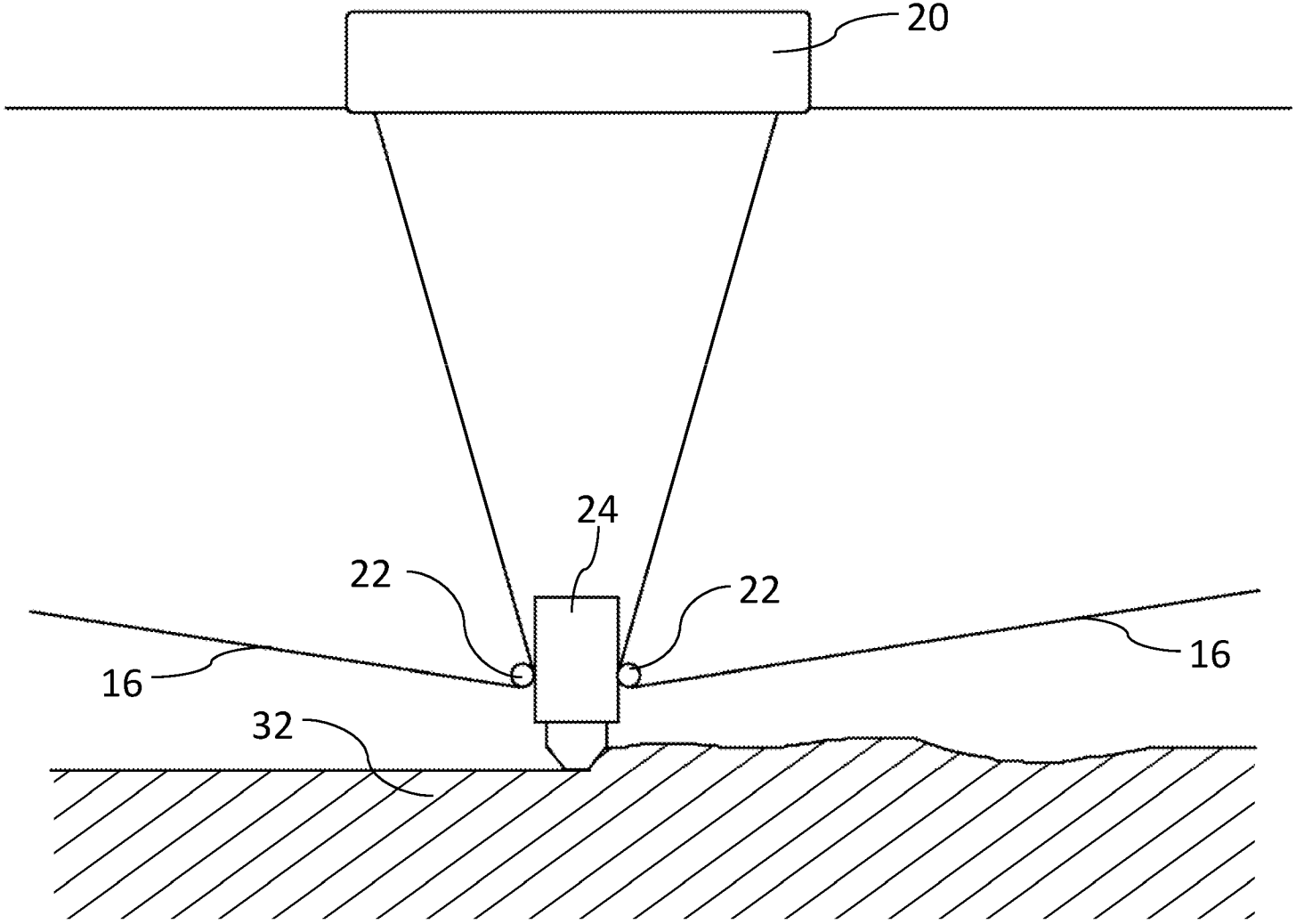
FIG. 1 is a side elevation view of a submersible assembly dredging the bottom of a body of water.
Figure 2:
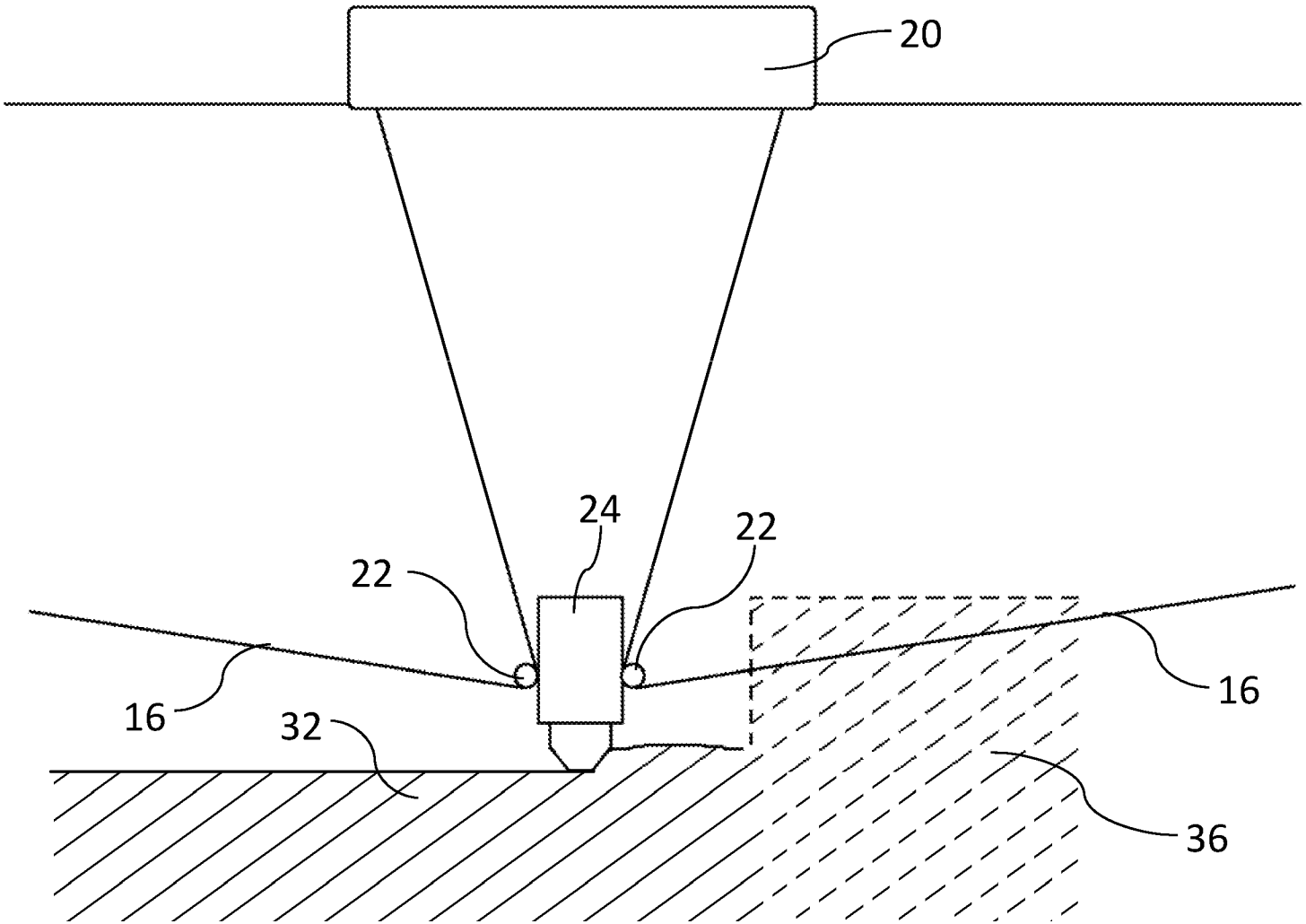
FIG. 2 is a side elevation view of a submersible assembly dredging the bottom of a body of water and about to encounter an unknown obstacle.

Referring to FIG. 1, a remote end 18 of each cable 16 is attached from winching station 12 to float 20. Cable 16 passes through a pulley assembly 22 and is attached to a submersible assembly 24, or dredge. As described herein, pulley assembly 22 has a variable resistance to the movement of cable 16. Preferably, this is done by varying the ability of the rotating component within a pulley to turn, and the term pulley 22 as used with the embodiments depicted and described herein will be in this context. However, resistance to cable movement may also be provided using a separate component that grips cable 16 along its length adjacent to pulley 22, and thereby resists the movement of cable 16 through pulley 22.

It will be understood that, while only two cables 16 and pulleys 22 are shown in FIG. 1, this is done for simplicity in the drawings, and that at least one additional cable 16 will be provided in connection with a corresponding winching station 12 and through corresponding pulleys 22 in a similar manner. Referring to FIG. 10, submersible assembly 24 has a cutter 26 and a submersible pump 28 with a pump line 30 that allows material removed by cutter 26 to be pumped away for disposal. For simplicity, pump line 30 is not shown in the operation of submersible assembly depicted in FIG. 1 through 7. It will also be understood that submersible assembly 24 is depicted generically, and may take any appropriate form that permits pulleys 22 to be securely fastened thereto. As used herein, the term "pulley" is intended to refer to any device that permits the movement and change of direction of cable 16 and may include rollers or other suitable designs. In addition, the term "cable" is intended to refer to any elongate, flexible member that is capable of being operated on by a winch and is able to be redirected by the pulley. Preferably, cable 16 is non-elastic or substantially non-elastic.

Referring again to FIG. 1, cables 16 are tensioned by winching stations 12. The tension in cables 16 is used to suspend submersible assembly 24 at a desired depth within the body of water, and preferably in contact with the bottom 32 of the body of water 10 under normal operation. The length of cables 16 between float 20 and pulley 22 may be such that submersible assembly 24 is suspended primarily by the tension in cables 16 between winch 14 and pulley 22, or the float 20 may provide some buoyant force to suspend submersible assembly 24. Float 20 is shown as being vertically above and aligned with submersible assembly 24, and will generally follow the position of submersible assembly 24 as it is moved through the area being dredged. However, it will also be understood that if pulley 22 is locked, and submersible assembly 24 is supported wholly by the tension applied by winches 14, the length of cables 16 to float 20, being fixed, may allow float 20 to be offset from the position of submersible assembly 24, depending on the depth of submersible assembly 24. When the resistance of pulley assembly 22 is reduced, and tension is applied to lift submersible assembly 24, float 20 will be pulled into vertical alignment with submersible assembly 24. Float 20 is designed to be sufficiently buoyant to support the weight of submersible assembly 24, along with the additional weight of cables 16. As float 20 is attached to cables 16, which pass through pulleys 22, the position of float 20 will generally follow the movement of submersible assembly 24, which is controlled by cables 16 and winching stations 12. Float 20 may be tethered to another point (not shown) other than submersible assembly 24, such as to a fixed structure on shore. The position of float 20 may also be pulled or pushed along the dredging pattern to reduce the effects of wind on float 20, or the drag experienced by submersible assembly 24 as it pulls float 20. It will also be understood that in some circumstances float 20 may be permitted to drag behind the position of submersible assembly 24 during normal movement of submersible assembly 24, in the case where the tension of cables 16 provides the required force to suspend submersible assembly 24. Float 20 may then be primarily used in order to lift submersible assembly 24, as will be described further below, by reducing the resistance of pulley 22, and allowing a portion of the weight of submersible assembly 24 to be supported by float 20. For example, in the event of submersible assembly 24 encountering an obstacle 36, the loads applied by winching stations 12 to lift the submersible assembly 24 may be reduced by using the buoyancy of float 20. As such, float 20 may be provided to either make available a greater range of depths at which submersible assembly 24 can be positioned without increasing the tension in cables 16 beyond a predetermined threshold, or float 20 may allow submersible assembly 24 to reach a particular depth more efficiently. Float 20 and pulleys 22 allow for tension on cables 16 to lift submersible assembly 24 in order to traverse an obstacle 36 while avoiding excessive tension in cables 16.

Once submersible assembly 24 is installed and positioned at the desired location in body of water 10, cutter 26 and submersible pump 28 are activated, and the operation of each winching station 12 is controlled in a coordinated manner to move submersible assembly 24 in a dredging pattern through the area to be dredged. As an example, the dredging pattern may be a spiral, a series of lines in reversing directions, or other patterns as are known in the art. The system may use pre-programmed dredging patterns programmed into controller 34, or may use a computer with position sensors to determine its location, and determine an optimal dredging path based on sensed information. The dredging pattern may also be based on previous dredge operations to avoid detected obstacles, or to optimize movement through types of material, etc.

The position of float 20 and submersible assembly 24, and the ability of cables 16 to move submersible assembly 24 through a dredging pattern will be affected, at least in part, by the resistance of pulleys 22. Pulleys 22 may be of any suitable design that allows their resistance to be modified. For example, a pulley with a high resistance will resist turning, and will therefore require a significant amount of force to pull cable 16 through pulley 22. This means that, as the resistance of pulley 22 increases, it acts more like a fixed point on submersible assembly 24. In some cases, it may be desirable to lock the pulley 22, i.e. approach infinite resistance, which will effectively fix the depth of submersible assembly 24 below float 20. In other cases, it may be desirable to reduce the resistance of pulley 22 to a low value, and the resistance may approach zero, which makes it easier to adjust the depth of submersible assembly 24. As tension is applied to cables 16 by each winching station 12, a portion of the force will urge submersible assembly 24 up toward float 20, depending on the relative tension applied along each cable 16, and the resistance of pulley 22. As such, the vertical movement of submersible assembly 24, or its apparent weight on bottom 32 of body of water 10 may be controlled by adjusting the resistance of pulley 22 and the tension applied by winching stations 12. In particular, submersible assembly 24 may be manipulated by applying a desired net force via cables 16 at a desired resistance of pulleys 22, and based on the weight of submersible assembly 24 in water. In one example, the resistance of pulleys 22 may be varied between a locked state, and an unlocked state. In one example, the variable resistance pulley 22 may be a ratcheting pulley that can be locked and unlocked. Alternatively, the resistance may be controlled between multiple intermediate values. For discussion purposes, the resistance is assumed to be ideal. It will be understood that, in practice, perfect resistances of 0% and 100% are impossible to achieve due to factors such as the inherent friction between surfaces. These considerations may be accounted for as required by those of ordinary skill.

Figure 3:
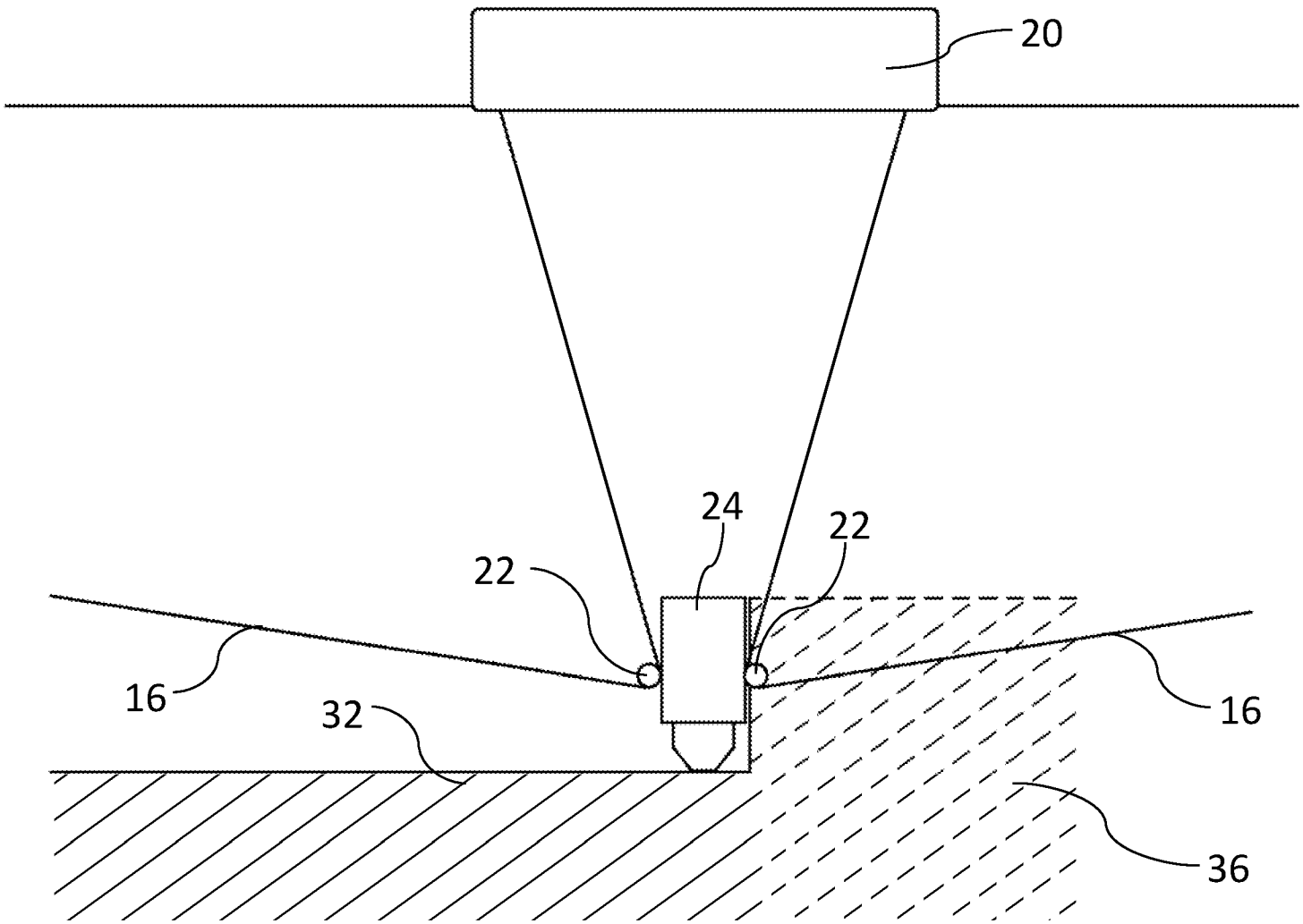
FIG. 3 is a side elevation view of a submersible assembly dredging the bottom of a body of water and having encountered an unknown obstacle.
Figure 4:
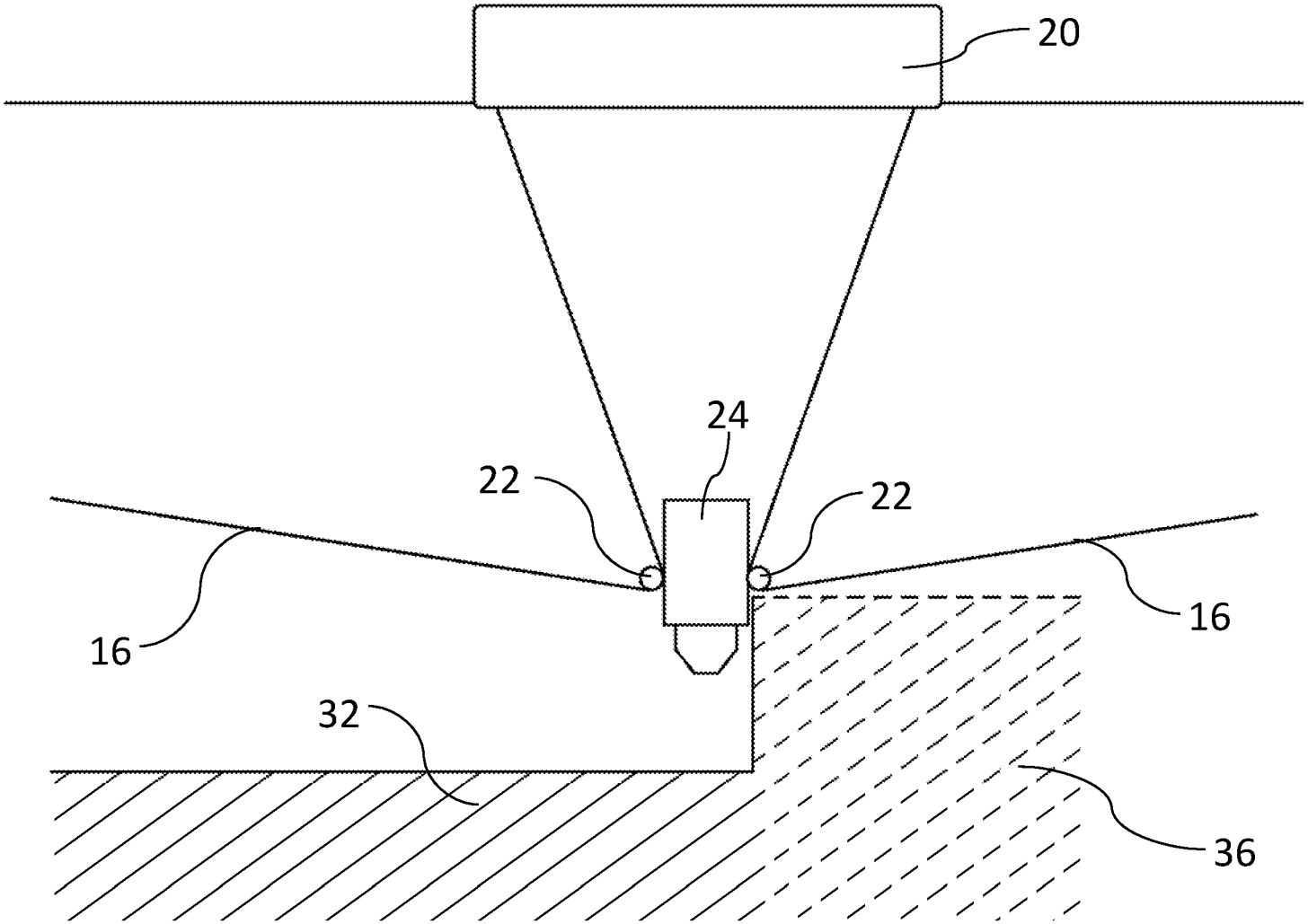
FIG. 4 is a side elevation view of a submersible assembly dredging the bottom of a body of water and travelling upward along the obstacle.
Figure 5:
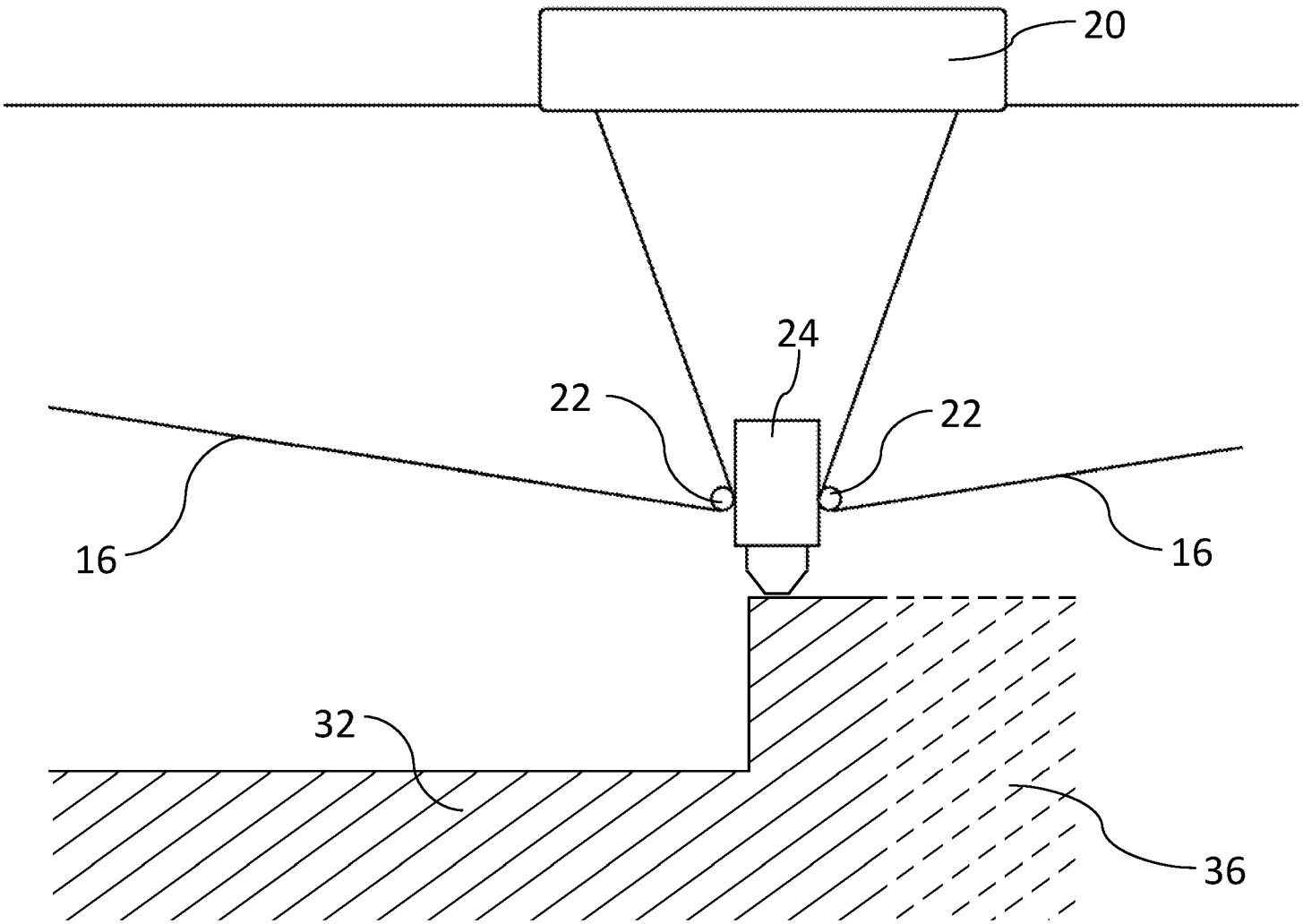
FIG. 5 is a side elevation view of a submersible assembly travelling along the top of the obstacle.
Figure 6:
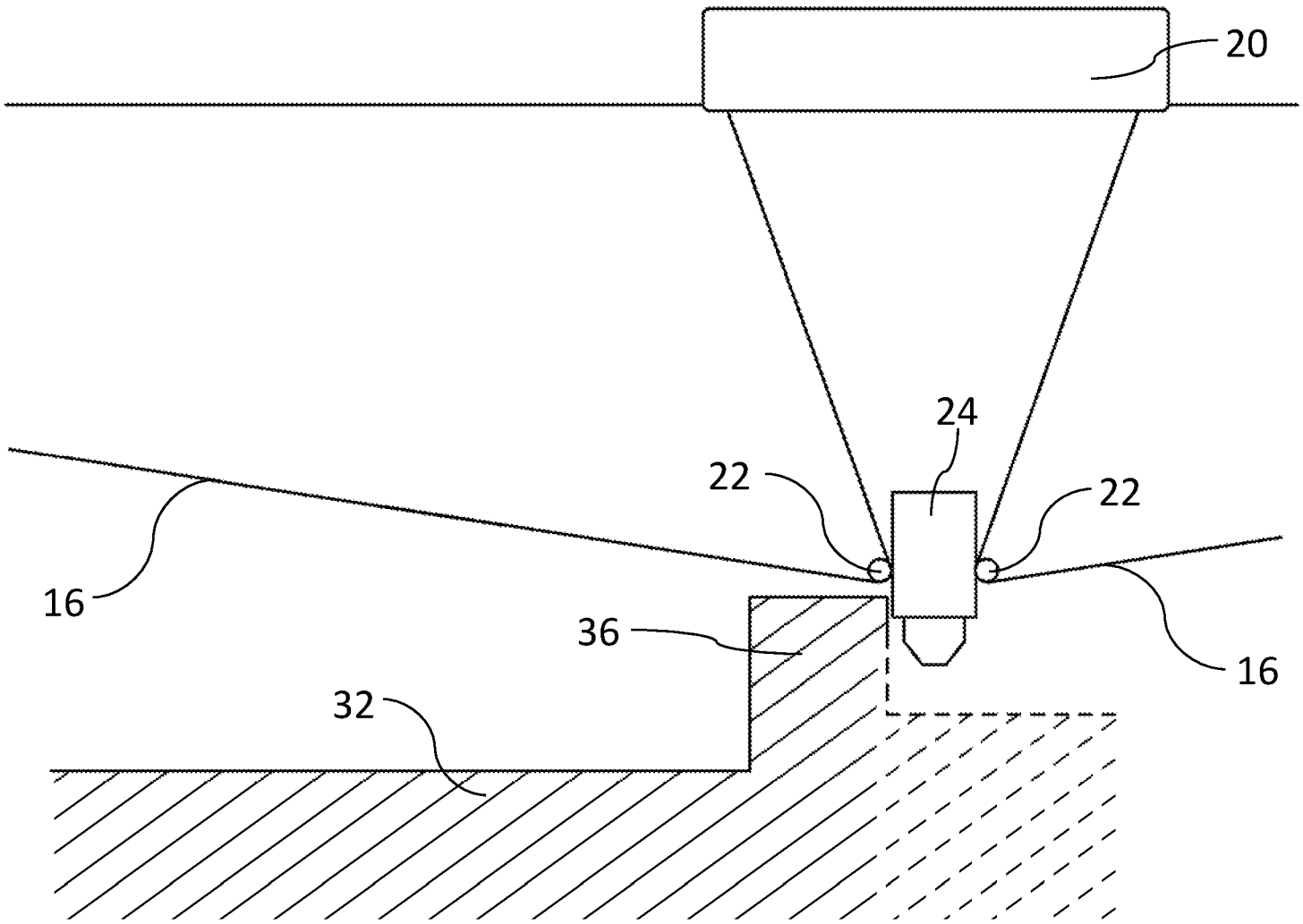
FIG. 6 is a side elevation view of a submersible assembly returning to the bottom of a body of water after traversing the obstacle.

Referring to FIG. 10, the operation of winches 14 may be controlled by a controller 34, as shown in FIG. 10. Controller 34 may also control the resistance of pulleys 22 in coordination with the operation of winches 14. In this manner, controller 34 is able to adjust the dredging pattern and depth of submersible assembly 24. Referring to FIG. 3, this becomes particularly useful when submersible assembly 24 encounters an obstacle 36. An obstacle 36 in this case will be understood to be any object that, when encountered by submersible assembly 24, increases the tension on cables 16 beyond a given threshold. For example, the threshold may be a tension beyond which there is a risk of structural failure of cables 16, or may be a tension determined as a safe threshold of operation of winch 14. Obstacle 36 may, for example, be a barrier such that lateral movement of submersible assembly 24 is impeded, or may also be a volume of material that is more difficult to dredge, such as an area of denser material or sand bar. In that case, it may be easier to dredge the material when it is approached from a higher elevation. An obstacle 36 may also be characterized, for example, as an area that is found to increase the current draw of pump 30 beyond a predetermined threshold, or an area in which cutter 26 encounters a resistance to movement that is higher than a predetermined threshold, or an area in which the ratio of dredged material to water entering submersible assembly 24 is altered such that there is insufficient water entering submersible assembly 24. It will be generally understood that the previously provided examples are not intended to be limiting, and the definition of an obstacle may be determined based on a number of parameters related to the ability of submersible assembly 24 to effectively dredge area to be dredged 10 and the data available from any sensors associated with submersible assembly 24. In order to overcome the obstacle 36, the resistance of pulley 22 is decreased such that further tension on one or more cables 16 causes submersible assembly 24 to travel toward float 20, as shown in FIG. 4. Referring to FIG. 5, when submersible assembly 24 reaches the top of obstacle 36, it may travel along the top of obstacle 36. The resistance of pulley 22 may be increased upon reaching the top of obstacle 36 to fix the depth of submersible assembly 24 and the tension of cables 16 may again be manipulated to cause submersible assembly 24 to move laterally and therefore traverse the top of obstacle 36. The top of obstacle 36 may be detected by applying a net force that is toward obstacle 36 such that, either a change in the tension is detected or submersible assembly 24 begins to move once submersible assembly 24 reaches the top of obstacle 36. Alternatively, the depth of submersible assembly 24 may be changed incrementally, and lateral forces applied periodically to determine whether movement is possible. When the end of obstacle 36 is reached, as shown in FIG. 6, the resistance of pulley 22 may be decreased to permit submersible assembly 24 to move toward a desired depth below float 20. The tension of cables 16 may also be manipulated to allow submersible assembly 24 to move to the desired depth. The desired depth, may, for example, be the bottom 32 of body of water 10. The resistance of pulley 22 may then be increased to cause submersible assembly 24 to move laterally along bottom 32 of body of water 10. Where obstacle 36 is an area of thicker material, submersible assembly 24 may also be returned to obstacle 36 at a lower depth to accomplish the required dredging.

If the bottom 32 of body of water 10 is contoured and it is desired to follow these contours, controller 34 may also be programmed to control the resistance of pulley 22 and the tension of cables 16 to allow submersible assembly 24 to follow the contours of bottom 32 of body of water 10. It will also be understood that submersible assembly 24 may be caused to return to the bottom 32 of body of water 10 and follow the contours of body of water 10 due to the balance of the weight of submersible assembly 24, the buoyancy of float 20, the resistance of pulley 22, and the tension on cables 16, such that submersible assembly 24 will sink unless an obstacle 36 converts additional tension from cable 16 into lifting force. Submersible assembly 24 may also be at a fixed depth due to pulleys 22 being locked, and may be equipped with a sensor that allows controller 34 to detect when submersible assembly is not in contact with the bottom 32 of body of water 10. For example, the effective weight of submersible assembly 24 on cables 16 below float 20 may be measured and used to determine when submersible assembly 24 should descend. In the case where the descent of submersible assembly 24 is from a fixed depth, pulleys 22 are unlocked to allow submersible assembly 24 to lower, and additional slack is provided by winches 14 on cables 16 such that submersible assembly 24 drops and the distance between submersible assembly 24 and float 20 increases. Pulleys 22 may also be designed to selectively apply an intermediate resistance, which may be used to reduce the effective weight of submersible assembly 24, in combination with tension applied by cables 16 and the ability of submersible assembly 24 to move laterally. It will also be understood that the tension on cables 16 may be controlled such that submersible assembly 24 is maintained as approximately level, or submersible assembly 24 may be allowed to tilt in response to the movement of cables 16. For example, it may be desired to maintain submersible assembly 24 as approximately normal to the bottom surface 32 of body of water 10. In this case, where bottom 32 is sloped, submersible assembly 24 may also be positioned to be at an angle to reflect the slope of bottom 32.

Figure 7:
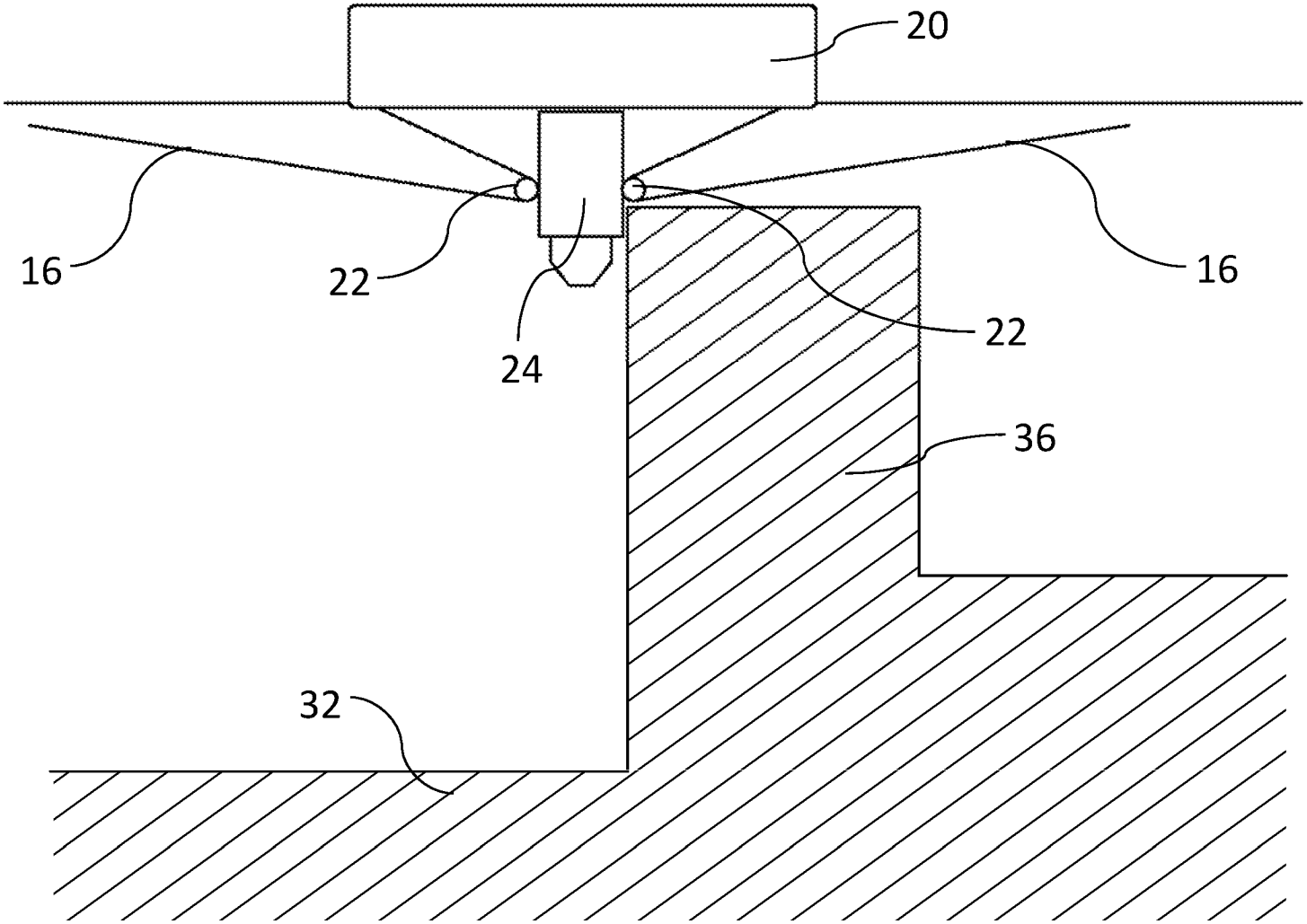
FIG. 7 is a side elevation view of a submersible assembly having encountered an obstacle that it cannot travel over.

Referring to FIG. 7, in some cases there may be obstacles in the body of water 10 that submersible assembly 24 is unable to traverse, such as when submersible assembly 24 reaches float 20 and cannot climb any higher up cable 16. In that case, winching stations 12 may manipulate the tension on cables 16 to cause submersible assembly 24 to travel around obstacle 36 laterally. Controller 34 may be used to record the location of the obstacle using a position sensor, such as a GPS, carried by submersible assembly 24 or float 20, as well as the path taken around obstacle 36 before returning to the planned dredging pattern. This information may then be used for subsequent passes in the dredging pattern, for future investigation, or for future dredging operations.

Referring to FIG. 4, it will be understood that the resistance of pulley 22 on the side of submersible assembly 24 that has encountered obstacle 36 may be decreased such that cable 16 can be pulled through pulley 22 and submersible assembly can climb cable 16 towards float 20 and over obstacle 36. The pulley or pulleys 22 that are not on the side that encounters obstacle 36 may also have their resistance controlled to allow submersible assembly 24 to climb cable 16. The tension on cable 16 from each winch 14 may also be controlled in a coordinated manner, such that submersible assembly 24 can climb obstacle 36 and continue along obstacle 36. For example, the resistance of pulley 22 on the opposite side of obstacle 36 may also be decreased to allow for movement of submersible assembly upwards along cable 16, and winch 14 of the corresponding cable 16 may be controlled to take in any slack created by the movement of submersible assembly 24 and maintain submersible assembly 24 level as it climbs.

Controller 34 includes a processor (not shown) that may be included as part of controller 34 or as a separate computing device, and that is used to make decisions regarding the operation of winches 14 and pulleys 22. Controller 34 may also be used to control other aspects of the operation of submersible assembly 24, such as pump speed, depth, optimized path for dredging operation, etc. These factors may be decided based on historical data, or data received by sensors during operation of submersible assembly 24 readings taking during as is understood by those skilled in the art, and will not be described further below.

For example, the computer may make a series of decisions based on the interaction of submersible assembly 24 with the surroundings. When the winches 14 are able to move the dredge laterally with a tension on cables 16 that is equal to or less than a predetermined threshold, the pulleys 22 may be locked, either by increasing resistance to the point that submersible assembly 24 will not climb cable 16, or by entirely preventing movement of cable 16 through or around pulley 22. When submersible assembly 24 cannot be moved laterally, or when the tension on cables 16 increases beyond the predetermined threshold, the pulley 22 may be released or the resistance decreased such that pulley 22 enables submersible assembly 24 to perform a speed limited climb off the bottom 32 of body of water 10. When winch 14 is again able to move submersible assembly 24 laterally, or the tension on cables 16 has decreased sufficiently, cables 16 are released to allow submersible assembly 24 to return to the bottom 32 of body of water 10, and then the resistance of the pulley 22 is increased or pulley 22 is locked such that no further vertical movement occurs, and the winches 14 continue to move submersible assembly 24 laterally. If, however, when vertically climbing cable 16, submersible assembly 24 encounters float 20 and can no longer ascend, winches 14 are then used to circumnavigate the obstacle. For example, submersible assembly 24 may be allowed to return to the bottom 32 of body of water 10, at which point the resistance on pulley 22 is increased, and winches 14 are used to move submersible assembly 24 along an alternate course to either try and find a way around obstacle 36, or to move along a known, safe path. In the instance where a computer is provided to track the movements of submersible assembly 24, the computer may identify the location as one with an obstacle 36 that cannot be climbed over, and may avoid passing through the area of the obstacle 36 on future passes or dredging operations. Depending on the data received, the computer may also attempt to plot the outline of obstacle 36.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of dredging a bottom of a body of water, comprising:

positioning at least three winching stations spaced at intervals around a perimeter of an area to be dredged, wherein each winching station comprises a winch and a cable;

connecting a remote end of each cable from each winching station to a float, the cable passing through a pulley assembly attached to a submersible assembly, the pulley assembly applying a variable resistance to cable movement, and the submersible assembly comprising a cutter and a submersible pump;

tensioning the cables sufficiently to suspend the submersible assembly in contact with the bottom of the body of water;

activating the cutter and submersible pump;

operating the winches in a coordinated manner to move the submersible assembly in a dredging pattern over the area to be dredged;

when an obstacle is encountered, decreasing the resistance of the pulley assembly and applying sufficient tension on the cable to lift the submersible assembly toward the float.

2. The method of claim 1, wherein, when the submersible assembly is lifted, the float is vertically above and aligned with the submersible assembly.

3. The method of claim 1, wherein, when a top of the obstacle is reached, increasing the resistance on the pulley assembly and controlling the tension of the cables to cause the submersible assembly to traverse the top of the obstacle.

4. The method of claim 1, wherein, when the obstacle is traversed, decreasing the resistance of the pulley assembly to permit the submersible assembly to move toward a desired depth below the float.

5. The method of claim 4, further comprising the step of increasing the resistance of the pulley assembly when the desired depth is reached.

6. The method of claim 1, wherein controlling the resistance of the pulley assemblies comprises locking the pulley assemblies to fix a depth of the submersible assembly within the body of water.

7. The method of claim 1, further comprising the step of controlling the resistance of the pulley assemblies and the tension of the cables to cause the submersible assembly to follow contours of the bottom of the body of water.

8. The method of claim 1, wherein the pulley assembly comprises a variable resistance pulley.

9. The method of claim 1, further comprising the step of detecting an obstacle based on at least the tension in the cables between the pulley assembly and the winches.

10. A method of dredging a bottom of a body of water, comprising:

positioning at least three winching stations spaced at intervals around a perimeter of an area to be dredged, wherein each winching station comprises a winch and a length of cable;

connecting a remote end of each cable from each winching station to a float, the cable passing through a pulley assembly attached to a submersible assembly, the pulley assembly applying a variable resistance to cable movement, and the submersible assembly comprising a cutter and a submersible pump;

tensioning the cables sufficiently to suspend the submersible assembly in contact with the bottom of the body of water;

activating the cutter and submersible pump;

operating the winches in a coordinated manner to move the submersible assembly in a dredging pattern over the area to be dredged; and controlling the resistance of the pulley assembly and the tension of the cables to control a vertical position of the submersible assembly.

11. The method of claim 10, wherein controlling the resistance of the pulley assembly and the tension of the cables comprises, when an obstacle is encountered, decreasing the resistance of the pulley assembly and applying sufficient tension on the cable to lift the submersible assembly toward the float.

12. The method of claim 11, wherein controlling the resistance of the pulley assembly and the tension of the cables further comprises increasing the resistance of the pulley assembly at a top of the obstacle and controlling the tension of the cables to traverse the obstacle.

13. The method of claim 11, wherein controlling the resistance of the pulley assembly and the tension of the cables further comprises, when the obstacle has been traversed, decreasing the resistance of the pulley assembly permit the submersible assembly to move toward a desired depth below the float, and thereafter increasing the resistance of the pulley assembly when the desired depth is reached.

14. The method of claim 10, wherein, when the submersible assembly is lifted, the float is vertically above and aligned with the submersible assembly.

15. The method of claim 10, wherein the resistance of the pulley assemblies and the tension of the cables is controlled to cause the submersible assembly to follow contours of the bottom of the body of water.

16. The method of claim 10, wherein controlling the resistance of the pulley assemblies comprises locking the pulleys to fix a depth of the submersible assembly within the body of water.

17. The method of claim 10, wherein the pulley assembly comprises a variable resistance pulley.

18. The method of claim 10, further comprising the step of detecting an obstacle based on at least the tension in the cables between the pulley assembly and the winches.

* * * * *